US005800766A

United States Patent [19]

Merry

[11] Patent Number: 5,800,766

[45] Date of Patent: Sep. 1, 1998

[54] METHOD OF COMPACTING A PLURALITY OF FLAT, STACKED, NON-WOVEN ARTICLES

[76] Inventor: Wayne M. Merry, 431-X Park Ridge La., Winston-Salem, N.C. 27104

[21] Appl. No.: 810,402

[22] Filed: Mar. 4, 1997

Related U.S. Application Data

[63] Continuation of Ser. No. 610,435, Mar. 4, 1996.

[51] Int. Cl.[6] ..... D21J 3/00; B65B 35/00; B65B 85/18; B30B 13/00

[52] U.S. Cl. ..... 264/324; 100/3; 100/35; 100/50; 100/240; 53/438; 53/447; 53/436; 53/529; 53/540; 264/415; 444/788.2; 444/789.9; 162/224; 162/214; 162/269; 206/294

[58] Field of Search ..... 100/35, 240, 3, 100/50; 53/438, 447, 436, 529, 540; 264/324, 415; 206/294, 494, 601; 223/57; 444/788.2, 789.9; 162/224, 214, 269; 15/228; 446/369; 5/636

[56] References Cited

U.S. PATENT DOCUMENTS

| | | | |
|---|---|---|---|
| 5,309,828 | 5/1994 | Merry | 100/35 |
| 5,417,912 | 5/1995 | Merry | 264/320 |
| 5,524,531 | 6/1996 | Merry | 100/35 |

*Primary Examiner*—W. Gary Jones
*Assistant Examiner*—Dianne Rees

[57] ABSTRACT

The present invention relates to a method of compacting a plurality of flat, stacked, non-woven cotton and cotton blend articles from a normal size to a greatly reduced size to form a package of such articles that saves exterior packaging, shipping, handling and warehouse costs. The pressure and time dwell are selected to compact the stacked articles to the extent necessary to cause the desired size reduction, but not sufficient to either damage the articles or compact them to the degree that a liquid or other means is required to recover them from their compacted to their original size.

4 Claims, 1 Drawing Sheet

METHOD OF COMPACTING A PLURALITY OF FLAT, STACKED, NON-WOVEN ARTICLES

This application is a continuation application of U.S. patent application Ser. No. 08/610,435 filed Mar. 4, 1996.

BACKGROUND OF THE INVENTION

1. Field of the Invention

This invention relates generally to a method of compressing flexible articles to a usable reduced size and more particularly to a method of compressing a plurality of flat stacked flexible articles into a compressed, compacted form which the articles will retain after removal of the applied pressure. The compacted articles can be subsequently returned to their original form and condition without the addition of additives or special procedures.

2. Description of the Prior Art

There are numerous available techniques for compressing fibrous articles but no known techniques for compressing a plurality of flat, stacked, non-woven, cotton and cotton blend flexible articles. For example, U.S. Pat. Nos. 2,659,935 (Hammon); 2,952,462 (Planin); 3,306,966 (Matejecek); 3,189,669 (Goldfein); 3,342,922 (Karpovich et al.); 3,504,064 (Bauer); and 4,529,569 (Palau) generally relate to methods for compressing a sponge material to a compacted, stable condition. A variety of techniques are disclosed in these patents, including the application of different agents, adhesives, temperatures and pressures. In all cases, however, some type of liquid agent, usually water, is required to return the sponge article to its original, normal and expanded condition. Moreover, in all of these patents, the article has approximately the same configuration in the compressed and expanded conditions. Some of the patents, for example, Bauer, require even more extreme conditions to return the article to its original shape; i.e., the application of both heat and steam.

There are also a number of patents relating to machines and methods for making tampons. See, for example, U.S. Pat. Nos. 2,134,930 (Reynolds); 2,336,744 (Manning); 2,425,004 (Rabell) ; and 2,462,178 (Ganz). These patents disclose a variety of different techniques for compressing fibrous materials to form tampons. These are notably different from the present invention. The material used is loose fibrous materials, as exemplified by the Manning patent, in which fibrous material enter through an opening and is deposited on the screen where air pressure causes it to form the pads. In addition, the nature of the product is such that there is no necessity for the product to be able to resume any original, uncompressed state in the absence of moisture. Further, many of these patents disclose quite elaborate folding or forming techniques. See, for example, the Rabell patent.

U.S. Pat. No. 4,096,230 is another example of sponge material which is compressed and is capable of returning to an uncompressed condition. This reference again relies upon the use of moisture to return the sponge material to its original shape. The article is a dehydrated prothesis for insertion end-wise into a body opening; i.e., the ear canal, where it absorbs moisture and returns to its original shape.

In all known prior art cases, any compression of sheet articles to a compacted, solidified form, which is stable after the pressure has been released, requires the article to be soaked in water for it to return to its original loose and uncompressed state. In general, the technique used is somewhat unsophisticated with the applied pressure and other parameters not being significantly controlled. In many cases, operators are unaware of the exact conditions to which the articles are subjected. This technique is applied to such articles as face cloths where it is acceptable to soak them in water to return the articles to their original state. Since a face cloth is wet prior to use, soaking it to bring it back to its original size is not detrimental or disadvantageous.

U.S. Pat. No. 4,421,007 (Tanaka et al.) is an example of the technique for producing a compressed cloth-like article which can be returned to its original state by absorption of water. Thus, this patent is intended for use on face cloths and the like and suggests the use of very high pressures, in the range of 1,100 to 1,500 kilograms per square centimeter, and preferably 1,200 to 1,300 kilograms per square centimeter. This significant pressure range is equivalent to pressures of 15,640 psi to 21,330 psi. In light of the discoveries made by the present applicant, these pressures are extraordinarily high.

Applicant has discovered that, for a variety of materials, pressures in excess of a few thousand psi result in unacceptable creases, thereby making the article unmarketable. The Tanaka et al. patent refers to a process which utilizes a pressure as low as 30 kilograms per square centimeter or approximately 425 psi. Again, this apparently is for an article which can be recovered to its original state only by absorbing water. The Tanaka et al. patent discusses in its examples the use of a binderless cellulosic non-woven fabric. Binderless cellulosic non-woven fabric appears to be higher in compression elasticity, thereby requiring higher pressures to ensure a well-compressed product which is not wrinkled at the edges. Indeed, the example uses a control at a pressure of 1,000 kilograms per square centimeter to show that the compression and molding is inadequate at this pressure.

In many cases, wetting a compressed article as purchased in order to return it to an original uncompressed condition for use is entirely unacceptable. In effect, a user would have to first wet the article to loosen and expand it, and subsequently dry the article.

It has been discovered, while working with non-woven, particularly knitted articles, that a plurality of flat sheets of such articles can be dramatically reduced in volume. Compacting such articles can bring about significant environmental benefits in that it will reduce the exterior packaging by a minimum of 10% to a maximum of 60%. It will also reduce transportation costs which directly contribute to environmental hazards.

The wide range of articles which can utilize the present form of compacting and packaging, can also save costs associated with handling and warehousing.

OBJECTIVES OF THE INVENTION

The general purpose, and hence the primary objective of the present invention, is to provide a method for producing a compressed stack of non-woven, cotton and cotton blend flat sheet articles which can be returned to their original state without the application of water or other liquids which would render the sheets initially unusable. Another objective of the present invention is to provide a method as described that will reduce exterior packaging, shipping, handling and warehouse costs because of the size and resulting space reduction experienced.

Yet still another object of the present invention is to implement a method covering the present inventive concept which will significantly reduce distribution and warehouse costs.

SUMMARY OF THE INVENTION

The present invention comprises a method of compressing and compacting a plurality of flexible, flat, stacked and non-woven cotton and cotton blend sheet articles to achieve a volume reduced compacted package of the articles by applying a predetermined amount of pressure to the article to reduce its regular volume without causing damage to the articles and subsequently permitting the articles to return to their original uncompressed condition. Pressure and dwell times are selectively predetermined, depending on the materials being compressed. Significantly, the articles are returned to their original state without the application of water or other substances which can affect their subsequent performance. Articles that can be used with the present inventive concept include non-woven materials, underwear (briefs and tops), dresses, slacks, socks, sweaters and toweling.

DETAILED DESCRIPTION OF THE SPECIFICATION

Figure 1:
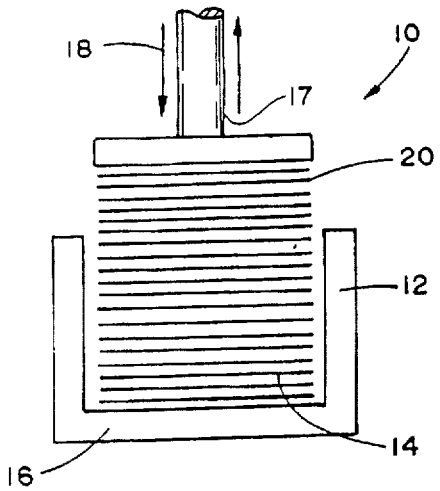
FIG. 1 is a side elevational and schematic view of a captured plurality (stack) of soft, flat, sheet articles before compaction.

Referring now to the drawings and particularly to FIG. 1, a shaping environment, shown generally as 10, has lower body element 12 that defines a cavity 14 which is closed at its lower end 16. A plunger 17 is sized to conform to the inside shape of element 12 to form a close sliding fit in cavity 14.

As indicated by arrow 18, plunger 17 is positioned to move downwardly into cavity 14. Obviously, it is immaterial whether body element 12 and plunger 17 move and, indeed, both elements can be moved simultaneously towards one another. A soft, flexible flat sheet article is indicated schematically at 20.

Figure 2:
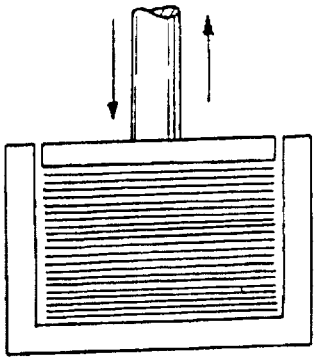
FIG. 2 is a side elevational view of the captured plurality (stack) of sheet articles of FIG. 1 being compacted using the method of the present invention.

FIG. 2 illustrates the downward movement by piston 17 which causes the application of a preselected pressure to the stacked articles 20.

Figure 3:
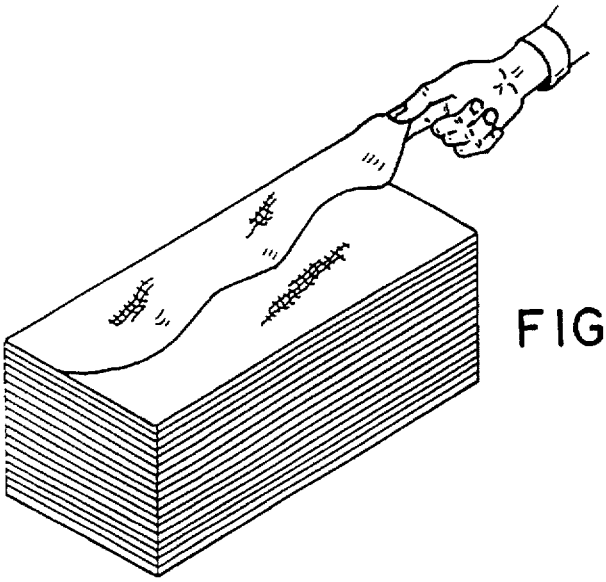
FIG. 3 is a perspective view of the captured plurality (stack) of sheet articles of FIGS. 1 and 2 after compaction resulting from the use of the method of the present invention.

FIG. 3 illustrates a compressed and compacted bundle of stacked articles formed in conjunction with the present inventive concept that can be manually and singularly handled and that will regain their original dimensions.

Figure 4:
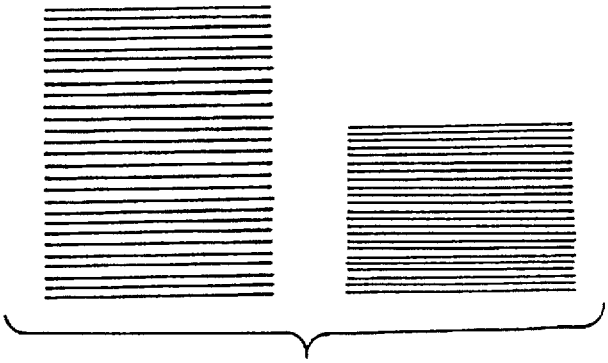
FIG. 4 is a side elevational, comparison view of the pre- and post-compaction stages of the stacked sheet articles of FIGS. 1, 2 and 3.

FIG. 4 shows a volume comparison before and after compaction of the plurality of stacked, flat articles utilizing the present invention.

The present invention resides in utilizing the method described herein in the low pressure ranges that have been determined to successfully accomplish the volume reductions desired. For example, pressure levels as low as 25 psi applied for time intervals as short as one second have been found to result in quite satisfactory results. For example, cotton T-shirts have been successfully reduced up to 50% in volume by compaction by pressures from 30–200 psi when applied for three seconds.

The following examples illustrate the successful application of the present inventive concept to a variety of non-woven articles.

TEST RESULTS

| Product | PSI Range From–To | Time | Volume Reduction |
|---|---|---|---|
| Fleece tops and pants | 10–75 | up to 10 secs | up to 40% |
| Underwear briefs & tops | 30–200 | up to 3 secs | up to 50% |
| Disposal non-woven coveralls | 25–5,000 | up to 3 secs | up to 45% |
| Dresses | 23–120 | up to 10 secs | up to 45% |
| Tee shirts | 30–200 | up to 3 secs | up to 50% |
| Slacks | 40–75 | up to 8 secs | up to 40% |
| Jeans | 2–55 | up to 10 secs | up to 50% |
| Hosiery (Socks) | 2–73 | up to 10 secs | up to 50% |
| Sweaters cotton & cotton blend | 3–75 | up to 10 secs | up to 50% |
| Towels | 3–50 | up to 10 secs | up to 55% |
| Mop Heads | 3,500–6,000 | up to 240 secs | up to 80% |
| Plush Toys | 2–75 | up to 30 secs | up to 60% |
| Pillows | .025–5 | up to 20 secs | up to 80% |
| Children's Apparel | 3–75 | up to 10 secs | up to 45% |
| Furniture Pads | 25–200 | up to 30 secs | up to 60% |
| Rugs | 5–200 | up to 10 secs | up to 50% |

In all cases utilizing the present concept, a significant reduction in size is accomplished without the necessity of applying water or some other additive to bring the size-reduced articles back to their original size and condition.

For most items, it is sufficient to compact the articles for comparatively short times, thus directly reducing packaging labor costs. Moreover, inserting these reduced size packages into a shipping container will result in additional cost efficiency.

With respect to the above description, it is realized that the optimum dimensional relationships for the parts of the invention, to include variations of size, materials, shape, form, function and manner of operation, assembly and use, are deemed readily and obvious to one skilled in the art, and all equivalent relationships to those illustrated in the drawings and described in the specification are intended to be encompassed herein. Therefore, the foregoing is considered as illustrative only of the principles of the invention. Further, since numerous modifications and changes will readily occur to those skilled in the art, it is not desired to limit the invention to the exact construction and operation shown and described. All suitable modifications and equivalents that fall within the scope of the appended claims are deemed within the present inventive concept.

What is claimed is:

1. A method of compacting a plurality of substantially flat, stacked, non-woven articles containing cotton from a normal size to a significantly reduced size comprising the steps: positioning the stacked articles in a shaping environment; subjecting the stacked articles to an elevated pressure for a predetermined period of time so that the stacked articles are compacted and reduced in size; and removing the pressure from the articles and the articles from the shaping environment whereby the articles can be individually removed from the stacked relationship and will thereafter return to their original, uncompacted condition without the application of any additional substances and wherein the stacked articles are mop heads, the pressure applied to compact the articles to achieve a volume reduction of approximately 80% is in the range of from 3,500 psi to 6,000 psi, and the period of time is up to 240 seconds.

2. A method of compacting a plurality of substantially flat, stacked, non-woven articles containing cotton from a normal size to a significantly reduced size comprising the steps: positioning the stacked articles in a shaping environment; subjecting the stacked articles to an elevated pressure for a predetermined period of time so that the stacked articles are compacted and reduced in size; and removing the pressure from the articles and the articles from the shaping environment whereby the articles can be individually removed from the stacked relationship and will thereafter return to their original, uncompacted condition without the application of any additional substances and wherein the stacked articles are plush toys, the pressure applied to compact the articles to achieve a volume reduction of approximately 60% is in the range of from 2 psi to 75 psi, and the period of time is up to 30 seconds.

3. A method of compacting a plurality of substantially flat, stacked, non-woven articles containing cotton from a normal size to a significantly reduced size comprising the steps: positioning the stacked articles in a shaping environment; subjecting the stacked articles to an elevated pressure for a predetermined period of time so that the stacked articles are compacted and reduced in size; and removing the pressure from the articles and the articles from the shaping environment whereby the articles can be individually removed from the stacked relationship and will thereafter return to their original, uncompacted condition without the application of any additional substances and wherein the stacked articles are pillows, the pressure applied to compact the articles to achieve a volume reduction of approximately 80% is in the range of from 0.025 psi to 5 psi, and the period of time is up to 20 seconds.

4. A method of compacting a plurality of substantially flat, stacked, non-woven articles containing cotton from a normal size to a significantly reduced size comprising the steps: positioning the stacked articles in a shaping environment; subjecting the stacked articles to an elevated pressure for a predetermined period of time so that the stacked articles are compacted and reduced in size; and removing the pressure from the articles and the articles from the shaping environment whereby the articles can be individually removed from the stacked relationship and will thereafter return to their original, uncompacted condition without the application of any additional substances and wherein the stacked articles are furniture pads, the pressure applied to compact the articles to achieve a volume reduction of approximately 60% is in the range of from 25 psi to 200 psi, and the period of time is up to 30 seconds.

* * * * *